United States Patent [19]

Calicchio

[11] 4,098,164

[45] Jul. 4, 1978

[54] MOUTHPIECE FOR MUSICAL WIND INSTRUMENTS

[76] Inventor: Domenick O. Calicchio, 702 Cherokee Ave., Los Angeles, Calif. 90038

[21] Appl. No.: 663,961

[22] Filed: Mar. 4, 1976

[51] Int. Cl.[2] ..... G10D 9/02

[52] U.S. Cl. ..... 84/399

[58] Field of Search ..... 84/398, 399

[56] References Cited

U.S. PATENT DOCUMENTS

| | | | |
|---|---|---|---|
| 1,012,140 | 12/1911 | Kunze | 84/399 |
| 1,691,669 | 11/1928 | Ostendorf | 84/399 |
| 3,370,500 | 2/1968 | Zwulak | 84/398 |
| 3,807,271 | 4/1974 | Nipkin | 84/399 |

*Primary Examiner*—Lawrence R. Franklin
*Attorney, Agent, or Firm*—Subkow and Kriegel

[57] ABSTRACT

A musical instrument mouthpiece includes a tubular stem having a shoulder, with a removable sleeve in the stem engaging the shoulder at one end, a cup in the stem engaging the other end of the sleeve with a rim secured to the stem and engaging the cup to hold it against the sleeve and the sleeve against the shoulder.

4 Claims, No Drawings

MOUTHPIECE FOR MUSICAL WIND INSTRUMENTS

The present invention relates to mouthpieces for musical wind instruments, such as trombones, coronets, trumpets and horns.

An object of the invention is to provide a mouthpiece in which the several parts can be varied in configuration to obtain different sound effects.

Another object of the invention is to provide a mouthpiece adapted to be varied to control the quality and volume of the sound emanating from the wind instrument to which the mouthpiece is attached.

A further object of the invention is to provide a mouthpiece made of a plurality of parts capable of being readily assembled and disassembled, and in which centering of the parts with respect to one another is assured.

This invention possesses many other advantages, and has other objects which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings.

Figure 1:
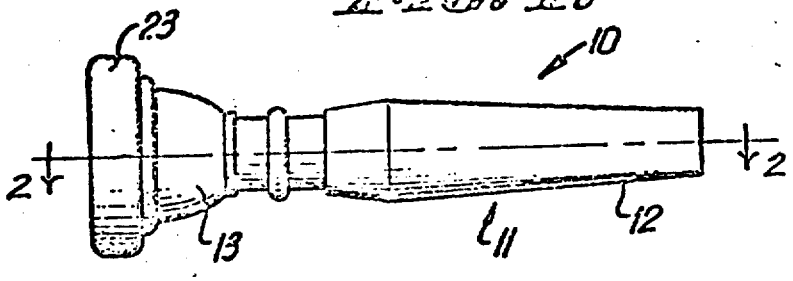
FIG. 1 is a side elevation of a mouthpiece embodying the invention.

As shown in the drawings, a mouthpiece 10 is provided that includes a main body or stem 11 having a tapered exterior 12 at one portion thereof for telescoping within the particular wind instrument (not shown) with which the mouthpiece is associated. The other end portion of the body or stem is formed as a bell or head 13, there being a central passage 14 extending completely through the body. This central passage includes a tapered bore 15, the wall of which diverges toward one end 16 of the body 11, as the right end illustrated in the drawings. This tapered bore opens into an intermediate counterbore 17 that is cylindrical, this counterbore, in turn, opening into another enlarged socket or counterbore 18 in the bell or head portion 13 of the body. The socket or bore 18 has a cylindrical wall, the base 19 of this counterbore tapering toward the axis of the body in a direction away from the left end 20 of the body, as shown in the drawings. The bell 13 has external threads 21 to receive companion internal threads 22 on a rim member 23 that has an inwardly directed flange 24 adapted to extend over the socket or bore 18 of the body.

Disposed within the intermediate counterbore 17, and of substantially the same length as this counterbore, is a sleeve 25 adapted to control the quality and volume of the sound. This sleeve has a cylindrical exterior to fit the cylindrical wall of the counterbore 17, one of its ends 26 engaging the base 27 of the counterbore, and its other end 28 being tapered to form a continuation of the taper of the base 19 of the enlarged socket or counterbore 18 at the rim end of the body 11. The sleeve 25 has a central passage 29 therethrough which extends from a throat portion 30 at the tapered end 28 of the sleeve to the other end 26 of the sleeve, this passage diverging in a direction away from the body head 13 and preferably merging smoothly into the tapered bore or passage portion 15 of the body or stem, such that the inner wall of the sleeve forms a smooth continuation of the inner wall of the tapered bore portion 15 of the body.

Disposed within the socket or enlarged counterbore 18 is a wind cup 31 that has a cylindrical periphery companion to the inner cylindrical wall of the enlarged bore 18. The inner end 32 of this wind cup is tapered to conform to the tapers of the counterbore base or bottom 19 and the tapered end 28 of the sleeve 25. The wind cup has a central passage 33 extending therethrough, the inner end or throat portion 34 of which is of a diameter conforming to the diameter of the throat 30 of the sleeve, the two throats merging into one another. The central passage 33 through the wind cup also includes an outer portion 35 that flares or diverges toward the rim 23 from the throat portion 34 to provide a tapered or concave cavity 36. The diameter of the outer end of this cavity is substantially equal to the diameter of the central passage 37 through the flange 24. The wind cup 31 itself will terminate substantially flush with the end 20 of the body when the wind cup engages the tapered base or seat 19 of the enlarged counterbore portion 18 of the body 11.

In assembling the mouthpiece, the sleeve 25 is slipped into the intermediate counterbore 17 and the wind cup 31 is then placed in the enlarged counterbore 18. The rim 23 is then threaded on the body head 13 and its flange 24 will engage the outer end of the wind cup and urge it against the tapered seat 19 of the enlarged counterbore, and also against the tapered end 28 of the sleeve 25, securing the other opposite end 26 of the sleeve against the base 27 of the intermediate counterbore 17. In this manner, the rim 23 holds the cup 31 and sleeve 25 in appropriate assembled position in the stem or body 11.

Because of the tapered engagement of the inner end 32 of the cup with the seat 19 of the enlarged counterbore, the cup 31 will be centered with respect to the axis of the stem or body 11. Accordingly, in the event of manufacturing errors of some of the parts, assurance is had that the cup is appropriately centered with respect to the body. Similarly, the tapered engagement between the tapered inner end 32 of the cup and the abutted tapered end 28 of the sleeve 25 will insure that the sleeve is centered relative to the cup 31, and that the passage 33 through the cup and the passage 29 through the sleeve are coaxial of one another. Accordingly, manufacturing errors, as between the outside diameter of the sleeve and the inside diameter of the intermediate counterbore 17, will not result in the sleeve 25 and cup 31 being offset with respect to one another. Instead, they will be coaxial, with the wall of the cup throat 34 merging smoothly into the wall of the sleeve throat 30.

Figure 2:
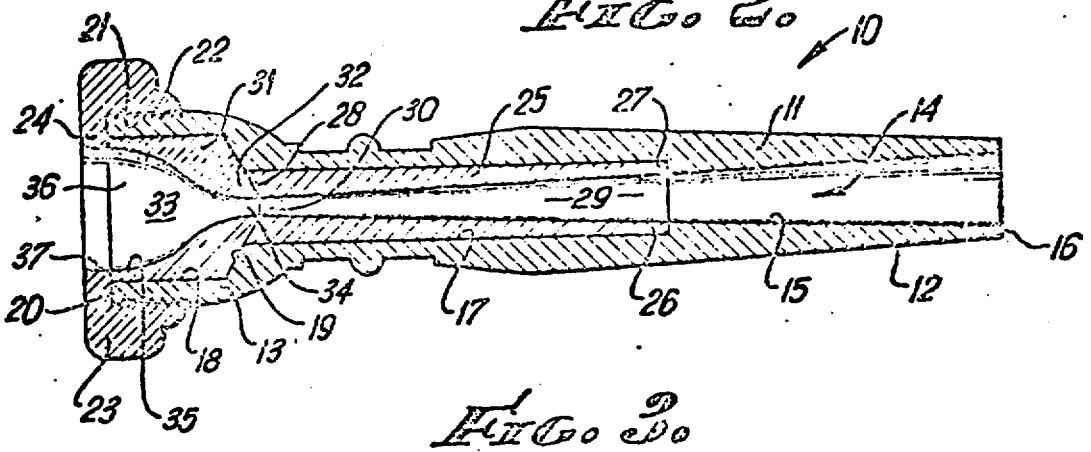
FIG. 2 is an enlarged longitudinal section of the mouthpiece taken along the line 2—2 in FIG. 1.
Figure 3:
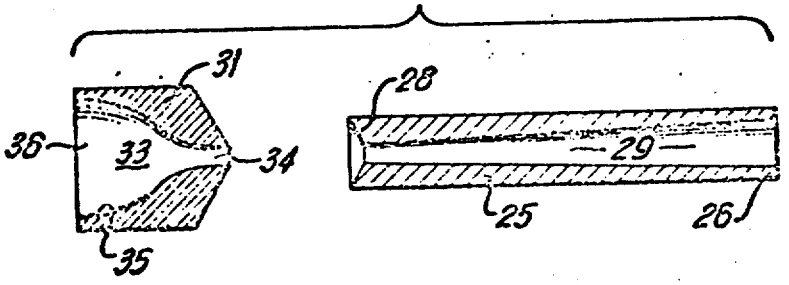
FIG. 3 is an exploded longitudinal section through the cup and sleeve portion of the mouthpiece shown in FIG. 2.

The rim 23 can be variously shaped to properly fit the mouth and teeth of the musician. The cup 31 and sleeve 25 can also be variously shaped to obtain different sound effects, as well as different quality of sound and volume of sound. As shown in FIGS. 2 and 3, a relatively deep cup 31 is provided, which is preferred for securing low register sound effects. The relatively sharp taper of the passage 29 through the sleeve 25 is also preferred to create a relatively sharp sound effect and a lesser sound volume.

Figure 4:
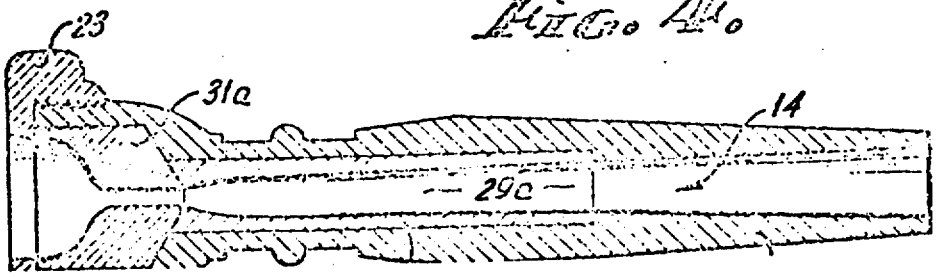
FIG. 4 is a view similar to FIG. 2 illustrating another specific configuration of cup and sleeve incorporated in the mouthpiece.

If the mouthpiece is provided with a relatively shallow cup 31*a* and a shallower tapered passage 29*a* in the sleeve 25*a*, such as disclosed in FIG. 4, essentially different sound effects will be secured than with the arrangement illustrated in FIG. 2. With the shallow cup 31*a*, high register sound effects will be secured, whereas, the shallower V-shaped passage 29*a* or taper in FIG. 4 will create greater sound volume and softer intonations.

Accordingly, it is evident that by assembling the mouthpiece with different shapes of cups, sleeves and rims, different sound effects can be obtained. Moreover, the size of the throats 34, 30 in the cup 31 and the sleeve 25 can also be changed. Regardless of which parts are assembled, they will be appropriately clamped in place with respect to one another as a result of threading the rim 23 on the head portion 13 of the body 11, with assurance that the cup and sleeve are mounted coaxial of the stem 11, because of the tapered coengagement 32, 19 between the cup and seat of the enlarged counterbore, and between the tapered end 32 of the cup and the tapered end 28 of the sleeve 25.

I claim:

1. A mouthpiece for a musical instrument, comprising:

a tubular stem having a first end and a second end connected by a unitary external surface forming a head adjacent said first end and an instrument receiving surface adjacent said second end, said head having means for removably securing a rim thereto;

said tubular stem having an internal bore therethrough, said bore including a central passage extending from said second end, an intermediate counterbore portion terminating in a first shoulder adjacent said stem passage, and an enlarged counterbore portion enclosed within said head extending from said stem first end to a second shoulder tapered inwardly toward said intermediate portion;

a sleeve removably disposed within said intermediate portion having one end engaging said first shoulder and the other end being tapered to form a continuation of said second shoulder taper, said sleeve having a central passage therethrough which diverges from a throat portion at said other end to said first shoulder engaging end, said sleeve central passage merging smoothly with said stem central passage;

a cup removably disposed within said enlarged portion having a tapered end companion to and engaging the tapers of said second shoulder and said sleeve and having a second end substantially flush with said stem first end, said cup having an internal central passage diverging from a throat portion which merges smoothly with said sleeve throat portion to said cup second end to form a cavity within said cup; and a rim removably secured to said securing means for holding said cup and said sleeve in said stem, said rim forcing the tapers of said cup, said second shoulder, and said sleeve to coaxially align said cup, said sleeve, and said stem, thereby assuring the smooth merging of said central passages.

2. A mouthpiece as defined in claim 1 wherein said securing means comprises a threaded end portion, said rim being secured to said stem by a threaded portion on said rim threaded on said threaded end portion.

3. A mouthpiece as defined in claim 1 wherein said stem central passage is tapered.

4. A mouthpiece as defined in claim 1 in combination with a plurality of cups and sleeves, each of which has substantially the same external configuration as the aforesaid cup and sleeve, respectively, but has a differently shaped central passage, thereby providing different sound effects when used in said mouthpiece.

* * * * *

UNITED STATES PATENT AND TRADEMARK OFFICE

CERTIFICATE OF CORRECTION

PATENT NO. : 4,098,164

DATED : July 4, 1978

INVENTOR(S) : Domenick O. Calicchio

It is certified that error appears in the above—identified patent and that said Letters Patent is hereby corrected as shown below:

The attached sheet of drawing should be inserted as part of the above-identified patent.

Signed and Sealed this

*Twenty-ninth* Day of *January 1980*

[SEAL]

*Attest:*

SIDNEY A. DIAMOND

*Attesting Officer*

*Commissioner of Patents and Trademarks*